United States Patent [19]

Holmes et al.

[11] Patent Number: 4,754,193

[45] Date of Patent: Jun. 28, 1988

[54] MERCURY DISPENSER FOR ARC DISCHARGE LAMPS

[75] Inventors: James L. Holmes, Montoursville; Billy W. Tuttle, Williamsport, both of Pa.; Emery G. Audesse, Beverly, Mass.

[73] Assignee: GTE Products Corporation, Danvers, Mass.

[21] Appl. No.: 796,362

[22] Filed: Nov. 8, 1985

[51] Int. Cl.[4] ..... H01J 17/26; H01J 61/28

[52] U.S. Cl. ..... 313/490; 313/546; 445/9

[58] Field of Search ..... 313/490, 546, 550, 564–565; 206/528, 532; 222/3, 4; 445/9, 10, 16, 60

[56] References Cited

U.S. PATENT DOCUMENTS

| | | | |
|---|---|---|---|
| 2,283,189 | 5/1942 | Cox | 313/546 |
| 2,288,253 | 6/1942 | Reuter | 313/546 |
| 2,322,421 | 6/1943 | Cox | 313/546 |
| 2,415,895 | 2/1947 | Lopez | 313/546 |
| 2,991,387 | 7/1961 | McCauley | 313/546 X |
| 3,230,027 | 1/1966 | Mayer | 313/546 X |
| 3,300,037 | 1/1967 | De Santis | 313/546 X |
| 3,657,589 | 4/1972 | Della Porta et al. | 313/178 |
| 3,728,004 | 4/1973 | Waymouth | 316/4 |
| 3,764,842 | 10/1973 | Ridders et al. | 313/546 |
| 3,794,402 | 2/1974 | Ridders et al. | 313/546 X |
| 3,895,709 | 2/1975 | Przybylek | 313/546 X |
| 3,913,999 | 10/1975 | Clarke | 316/4 |
| 3,983,439 | 9/1976 | Blommerde et al. | 313/546 X |
| 4,056,750 | 11/1977 | Latassa | 313/177 |
| 4,182,971 | 1/1980 | Cassidy et al. | 313/177 |
| 4,282,455 | 8/1981 | Latassa et al. | 313/177 |
| 4,335,326 | 6/1982 | Latassa et al. | 313/177 |
| 4,427,919 | 1/1984 | Grefall | 313/546 |
| 4,494,042 | 1/1985 | Roche | 315/56 |

FOREIGN PATENT DOCUMENTS 2040554 8/1980 United Kingdom .

*Primary Examiner*—David K. Moore
*Assistant Examiner*—Sandra L. O'Shea
*Attorney, Agent, or Firm*—Carlo S. Bessone

[57] ABSTRACT

A mercury capsule for dispensing mercury into an arc discharge lamp comprises a tubular metal member having a main body portion, a sealed end portion immediately adjacent the main body portion and means for sealing the end portion. The sealing means includes a substantially undulating configuration containing a predetermined number of undulations to enable rupture of the mercury capsule at an elevated temperature in accordance with the number of undulations. In a preferred embodiment of the invention, the mercury capsule is formed from a metal cup having a larger diameter skirted portion and a smaller diameter portion.

15 Claims, 3 Drawing Sheets

MERCURY DISPENSER FOR ARC DISCHARGE LAMPS

TECHNICAL FIELD

This invention relates to low pressure arc discharge lamps, particularly fluorescent lamps, which contain mercury. It is especially concerned with the means by which mercury is introduced into the lamp.

BACKGROUND OF THE INVENTION

One of the most commonly used method for introducing mercury into a lamp is a mechanical dispensing unit which forms part of a so-called exhaust machine. Mercury is dispensed by the action of a slotted plunger passing through a reservoir of mercury and into the closed exhaust chamber housing the exhaust tube. The mercury falls through the exhaust tube into the lamp. This method of dispensing mercury has many drawbacks. In the first place, the mercury dispensing unit complicates the exhaust machine. In the second place, the mercury is introduced into the lamp envelope which is at a high temperture and which is in open communication with the exhaust machine. As a result it is inevitable that a portion of the introduced mercury evaporates and disappears from the lamp, or a portion of the filling gas is driven out of the lamp. Furthermore, the inroduction of mercury through the exhaust tube involves the risk of mercury getting stuck in the exhaust tube so that after sealing off the lamp it contains too little or no mercury at all. For these reasons a large excess of mercury, namely a multiple of the quantity required by the lamp is generally introduced. Finally, working with mercury on the exhaust machine requires additional safety precautions on medical grounds.

An alternative method of dispensing mercury, as shown for example in U.S. Pat. Nos. 3,657,589 and 3,728,004, is to place inside the lamp a mercury compound that is inert under lamp processing conditions but can later be activated to release mercury. Disadvantageously, this method releases impurities, which then require special gettering. It also requires a relatively long period of time (20 to 30 seconds) to activate the mercury compound. As a result, this method of dispensing mercury does not readily lend itself to high speed production machinery.

The drawbacks described hereinbefore may be obviated by placing the mercury to be introduced into the lamp in a closed capsule mounted within the lamp, whereafter the lamp is provided with the desired fill gas and is subsequently sealed. The mercury containing capsule is not opened until all manufacturing steps relating to the exhaust process have been completed.

The above-mentioned mercury capsules are generally fabricated from glass or metal. Examples of mercury containing glass capsules are shown for example in U.S. Pat. Nos. 2,415,895; 2,991,387; 3,764,842; 3,794,402; 4,182,971 and 4,335,326. These examples require special heaters proximate the capsule or an additional capsule shield to prevent loose capsule particles within the lamp upon capsule rupture.

Examples of mercury containing metal capsules are shown for example in U.S. Pat. Nos. 2,288,253; 2,322,421; 3,300,037; 3,895,709; 3,913,999; 3,983,439; 4,056,750 and 4,282,455; and Great Britain patent application No. 2,040,554A. The metal mercury capsules contained at least one end portion sealed by flat crimping or cold welding followed in some instances by resistance welding. The disadvantages of the above methods of sealing the end portion of the metal capsules include the inability to accurately control the desired temperature at which the mercury is released from the capsule. The type of seals used in the mercury capsule must be capable of withstanding the temperatures of the glass sealing operation during the lamp manufacturing process which can exceed 300° C. Flat crimping or cold welding the mercury capsule has been found to be insufficient to repeatably contain the mercury within the capsule during these relatively high temperatures. Increasing the crimping pressure in an attempt to contain the mercury can result in metal fatigue. Furthermore, some of the methods of sealing the mercury capsule, for example, U.S. Pat. Nos. 3,895,709 and 3,913,999 which use resistance and/or cold welds, necessitate the need for expensive laser equipment to release the mercury within the capsule.

SUMMARY OF THE INVENTION

It is, therefore, an object of the invention to obviate the disadvantages of the prior art.

It is another object of the invention to enhance the dispensing of mecury in an arc discharge lamp.

It is still another object of the invention to provide a mercury dispenser in an arc discharge lamp which can be produced on high speed manufacturing equipment.

It is still another object of the invention to provide a method for the manufacture of a mercury capsule.

It is still another object of the invention to provide an improved means for controlling the temperature at which the mercury is released from a mercury dispenser.

These objects are accomplished, in one aspect of the invention, by the provision of a mercury capsule comprising a tubular metal member having a main body portion which contains a predetermined amount of mercury to be released thereform, a sealed end portion immediately adjacent the main body portion for providing a seal for the capsule and means for sealing the end portion. The sealing means has a substantially undulating configuration containing a predetermined number of undulations to enable rupture of the capsule at an elevated temperature in accordance with the number of undulations.

In accordance with further aspects of the present invention, the end portion further includes a flattened tail portion immediately adjacent the undulations and remote from the main body portion.

In accordance with the teachings of the invention, the mercury capsule is formed form a cup having a predetermined length and having a larger diameter skirted portion and a smaller diameter portion. Preferably, the flattened tail portion is formed substantially in the larger diameter skirted portion is formed substantially in the larger diameter skirted portion and the predetermined number of undulations is formed substantially in the smaller diameter portion.

In accordance with additional aspects of the invention, a method for the manufacture of a mercury capsule comprises the steps of providing a tubular metal member having a main body portion and an end portion. The tubular metal member is filled with a predetermined amount of mercury. The end portion is sealed by crimping with a predetermined amount of pressure to form a substantially undulating configuration containing a predetermined number of undulations. Preferably, the predetermined amount of pressure is within the range of approximately 200 to 550 pounds per square inch.

The objects of the invention are further accomplished, in one aspect of the invention, by the provision of an arc discharge lamp having an envelope of light-transmitting vitreous material having opposed end portions and containing an inert starting gas, a first and second electrode located within a respective one of the end portions, a pair of lead-in wires respectively connected to the first and second electrode, wherein the improvement comprises a mercury capsule secured to one of the lead-in wires. The mercury capsule is formed from a tubular metal cup having a main body portion for containing a predetermined amount of mercury to be released therefrom. The mercury capsule further includes a sealed end portion for providing a seal for the capsule and means for sealing the end portion. The sealing means has a substantially undulating configuration containing a predetermined number of undulations to enable rupture of the capsule at a predetermined elevated temperature in accordance with the number of undulations. Preferably the arc discharge lamp is a fluorescent lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
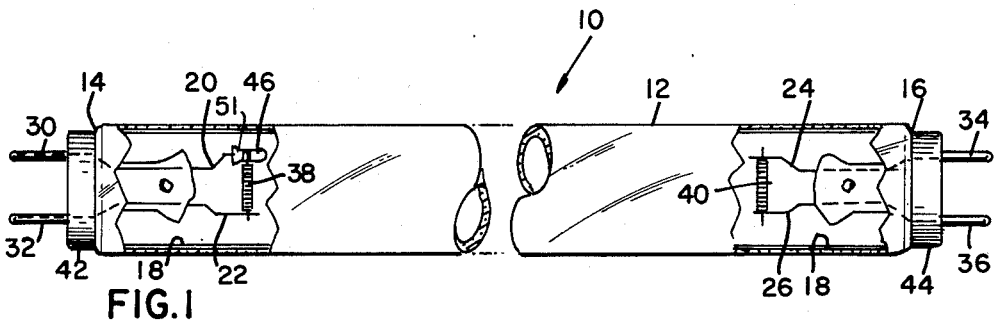
FIG. 1 is a partly broken away, perspective view of an arc discharge lamp containing a mercury capsule in accordance with this invention.
Figure 2:
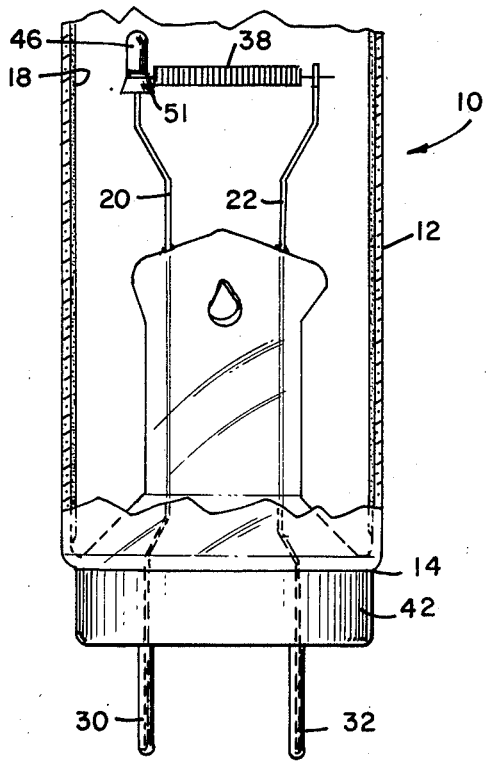
FIG. 2 is an enlarged, perspective view of a portion of the arc discharge lamp in FIG. 1.

Referring now to the drawings with greater particularity, there is shown in FIGS. 1 and 2 a fluorescent arc discharge lamp 10 having a sealed envelope 12 of light-transmitting vitreous material. Envelope 12 has opposed end portions 14, 16, and encloses an inert starting gas. The starting gas may consist of argon, neon, helium, krypton or a combination thereof at a low pressure in the range of about 1 to 4 mm Hg.

A first electrode 38 and a second electrode 40 are located within opposed end portions 14 and 16, respectively. Electrodes 38, 40 are coated with electron-emitting materials such as BaO-SrO-CaO containing $MgZrO_3$. A pair of lead-in wires 20, 22 connects electrode 38 and a pair of lead-in wires 24, 26 connect electrode 40. Suitable bases 42,44 carrying contacts 30, 32, 34, 36 are respectively sealed adjacent end portions 14, 16. Lead-in wires 20, 22, 24, 26 are electrically connected to contacts 30, 32, 34 and 36, respectively.

A phosphor coating 18 is disposed on the interior surface of envelope 12. Phosphor coating 18, which can be a halophosphate phosphor such as Cool White, is responsive to the ultraviolet radiation generated by the plasma discharge to provide a desired emission spectrum.

In accordance with the invention and as shown in FIGS. 1 and 2, fluorescent are discharge lamp 10 contains a mercury capsule 46 secured to lead-in wire 20 adjacent electrode 38 by welding at about spot 51.

Figure 3:
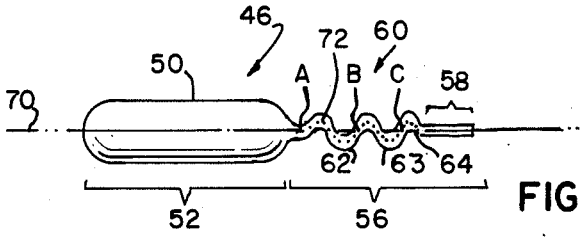
FIG. 3 is an elevational view of a mercury capsule in accordance with this invention.
Figure 4:
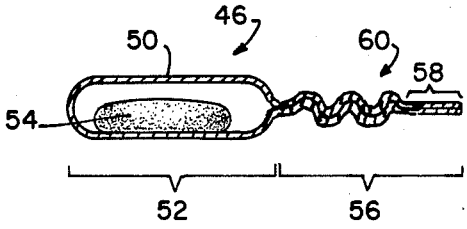
FIG. 4 is a cross-sectional view of the mercury capsule in FIG. 3.

As best shown in FIGS. 3 and 4, mercury capsule 46 comprises a tubular metal member 50 having a main body portion 52 which contains a predetermined amount of mercury 54 which is released into the lamp during lamp manufacturing. A sealed end portion 56 is provided immediately adjacent main body portion 52.

End portion 56 is sealed by means of a substantially undulating configuration 60 formed in capsule 46. Undulating configuration 60 contains a predetermined number of undulations 62, 63. An undulation, which may be substantially S-shaped or N-shaped in configuration, preferably alternates about the longitudinal axis 70 of mercury capsule 46. As best shown in FIG. 3, a single undulation 62 extends longitudinally from approximately A to B. Points A,B,C, and D in FIG. 3 represent the approximate locations where the center (dotted) line 72 of the undulations intersects longitudinal axis 70. A second undulation 63 is shown extending longitudinally from approximately B to C. A partial or half undulation 64 extends longitudinally from approximately C to D. For proper sealing, end portion 56 should contain at least one undulation 62.

In a preferred embodiment, sealed end portion 56 further includes a flattened tail portion 58 immediately adjacent the undulations and remote from main body portion 52.

Figure 6:
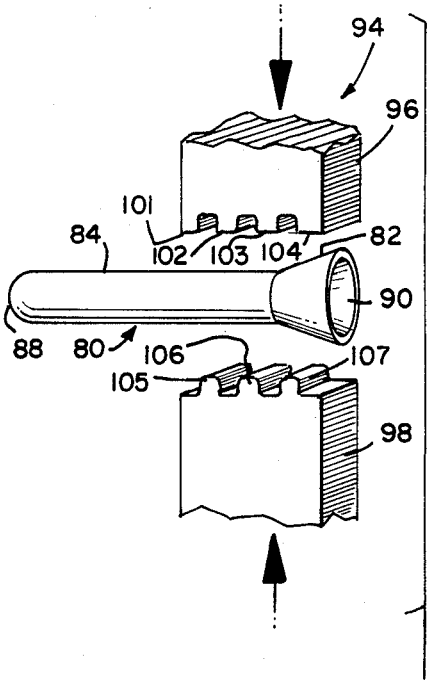
FIG. 6 is a perspective view of the metal cup in FIG. 5 along with a crimping tool used in sealing the metal cup.
Figure 5:
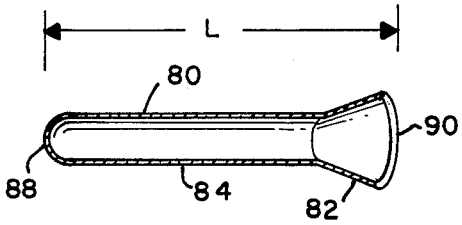
FIG. 5 is a cross-sectional view of a preferred embodiment of a metal cup before crimping having a larger diameter skirted portion and a smaller diameter portion.

As shown in FIGS. 5 and 6, according to the preferred method for the manufacture of the invention, mercury capsule 46 is formed form a generally tubular metal cup 80 of predetermined length L having a closed end 88 formed therein and an opened end 90. Preferably cup 80 has a larger diameter skirted portion 82 and a smaller diameter portion 84. An advantage of a double diameter cup over a single diameter cup is that the double diameter provides an advantageous means for orienting the cup prior to mercury filling. In addition, the larger diameter provides a greater target area for both mercury filling and welding to the lead-in wire, while the smaller diameter provides an advantageous means for faster transfer and feeding on manufacturing equipment.

Approximately 14 to 16 milligrams of mercury is dispensed into cup 80 through open end 90.

A sealed end portion 56 as shown in FIGS. 3 and 4 is formed by crimping with a predetermined amount of pressure open end 90 of cup 80 with a crimping tool 94 having an upper section 96 and a lower section 98. Upper section 96 has a plurality of teeth 101, 102, 103, 104 which mesh with lower section 98 and teeth 105, 106, 107. The width, shape and number of teeth on crimping tool 94 can be adjusted to obtain the desired undulating configuration (i.e., number and shape of undulations).

It has been discovered that by forming a substantially undulating configuration containing a predetermined number of undulations, the temperature at which the mercury is released from the capsule can be more accurately controlled than, for example, flat crimping or cold welding. The undulations increase the resistance of the sealed end portion 56 thus requiring a higher mercury pressure within main body portion 52 before mercury 54 is released from capsule 46. The number of undulations is increased or decreased in accordance with the lamp processing temperatures and the desired elevated rupture temperature. Depending on the temperatures encountered, one to about five undulations formed in the end portion is sufficient to contain the mercury during lamp processing and still allow the capsule to rupture at an elevated temperature encountered during the mercury releasing process. Adjusting the crimping pressure also changes the temperature required to release the mercury from the capsule.

EXAMPLE I

In a typical but non-limitative example, mercury capsule 46 was formed from a generally tubular metal cup 80 made from Niromet 426 and having a smaller diameter portion 84 of 0.060 inch (1.52 millimeters) outer diameter (O.D.), a wall thickness of approximately 0.0030 inch (0.076 millimeter) and a length L of 0.400 inch (1.016 centimeters). Metal cup 80 had a larger diameter skirted portion 82 with a maximum diameter of approximately 0.125 inch (3.175 millimeters). Approximately 16 milligrams of mercury was dispensed into the cup through the open end 90. A sealed end portion was formed by crimping at a crimping pressure of approximately 350 pounds per square inch (psi) using a crimping tool as shown in FIG. 6 to form 2.5 undulations substantially in the smaller diameter portion 84. The sealed end portion further included a flattened tail portion formed substantially in the larger diameter skirted portion 82 located immediately adjacent the undulations and remote from the main body portion.

As shown in FIGS. 1 and 2, the formed mercury capsule 46 was secured to one of the lead-in wires 20 adjacent the electrode 38 in an arc discharge fluorescent lamp 10. Fluorescent lamp 10 was a four foot T12 lamp having a 100 percent argon fill at 2.5 mm Hg.

Figure 7:
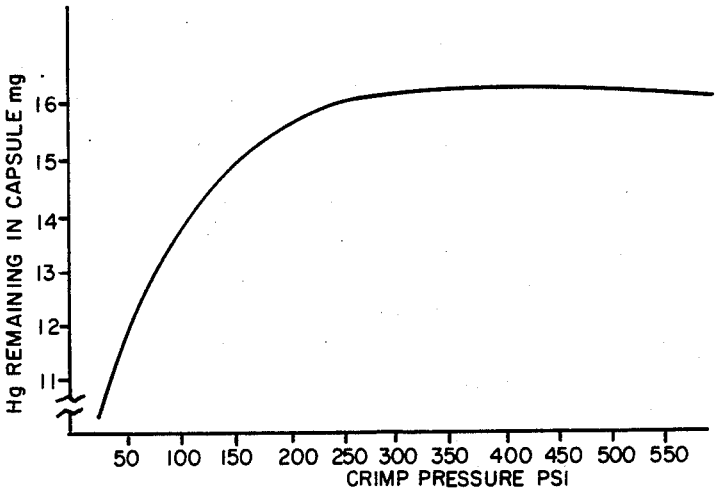
FIG. 7 is a graph illustrating the effect of crimp pressure on the amount of mercury remaining in the capsule after lamp processing and sealing.

FIG. 7 illustrates the effect of the crimping pressure of the crimping tool. The graph plots data obtained from the above-mentioned 40 watt-type lamps in which the amount of mercury remaining in the capsule was weighed after lamp processing and sealing but before being subjected to an elevated temperature sufficient to enable rupture of the capsule. The data is plotted on the bases of "Crimp Pressure psi" as abscissa and "Hg Remaining in Capsule mg." as ordinate. From the data it is evident that for best results, the crimping pressure should be withn the range of approximately 200 to 550 pounds per square inch (psi).

After lamp sealing, the mercury 54 in capsule 46 can be released by heating capsule 46 to an elevated temperature sufficient to cause capsule rupture by using the apparatus shown and described in U.S. Pat. No. 4,494,042, which issued to Roche on Jan. 15, 1985 and is assigned to the Assignee of the present application.

While there have been shown and described what are at present considered to be the preferred embodiments of the invention, it will be apparent to those skilled in the art that various changes and modifications can be made herein without departing from the scope of the invention as defined by the appended claims.

I claim:

1. A mercury capsule comprising:

a generally tubular metal member having a main body portion which contains a predetermined amount of mercury to be released therefrom;

a sealed end portion immediately adjacent said main body portion for providing a seal for said capsule; and means for sealing said end portion, said sealing means having a substantially undulating configuration containing a predetermined number of undulations to enable rupture of said capsule at an elevated temperature in accordance with the number of said undulations.

2. The mercury capsule of claim 1 wherein said sealed end portion further includes a flattened tail portion immediately adjacent said undulations and remote from said main body portion.

3. The mercury capsule of claim 2 wherein said mercury capsule is formed from a cup having a predetermined length and having a larger diameter skirted portion and a smaller diameter portion.

4. The mercury capsule of claim 3 wherein said flattened tail portion is formed substantially in said larger diameter skirted portion and said predetermined number of undulations is formed substantially in said smaller diameter portion.

5. The mercury capsule of claim 3 wherein said predetermined length of said cup is approximately 0.400 inch.

6. The mercury capsule of claim 1 wherein said predetermined number of undulations is 2.5.

7. A method for the manufacture of a mercury capsule comprising steps of:

providing a generally tubular metal member having an open end portion; dispensing a predetermined amount of mercury into said member; forming a sealed end portion, said sealed end portion being formed by crimping with a predetermined amount of pressure to form a substantially undulating configuration containing a predetermined number of undulations.

8. The method of claim 7 wherein said predetermined amount of pressure is approximately 350 pounds per square inch.

9. In an arc discharge lamp having an envelope of light-transmitting vitreous material having opposed end portions and containing an inert starting gas, a first and second electrode located within a respective one of said opposed end portions, a pair of lead-in wires connected to said first and second electrode, the improvement comprising: a mercury capsule secured to one of said lead-in wires, said mercury capsule being formed from a tubular metal cup having a main body portion for containing a predetermined amount of mercury to be released therefrom, a sealed end portion for providing a seal for said capsule, and means for sealing said end portion, said sealing means having a substantially undulating configuration containing a predetermined number of undulations to enable rupture of said capsule at a predetermined elevated temperature in accordance with the number of said undulations.

10. The arc discharge lamp of claim 9 wherein said arc discharge lamp is a fluorescent lamp.

11. The are discharge lamp of claim 9 wherein said mercury capsule further comprises a flattened tail portion immediately adjacent said undulations and remote from said main body portion.

12. The arc discharge lamp of claim 10 wherein said mercury capsule is formed from a cup having a predetermined length and having a larger diameter skirted portion and a smaller diameter portion.

13. The arc discharge lamp of claim 12 wherein said flattened tail portion is formed substantially in said larger diameter skirted portion and said predetermined number of undulations is formed substantially in said smaller diameter portion.

14. The arc discharge lamp of claim 12 wherein said predetermined length of said cup is approximately 0.400 inch.

15. The arc discharge lamp of claim 9 wherein said predetermined number of undulations is 2.5.

* * * * *